US005134439A

United States Patent [19]

Zuber

[11] Patent Number: 5,134,439

[45] Date of Patent: Jul. 28, 1992

[54] EXPOSURE COMPENSATION SYSTEM FOR A DUAL MODE ELECTROPHOTOGRAPHIC PRINT ENGINE

[75] Inventor: Peter A. Zuber, Norcross, Ga.

[73] Assignee: Colorocs Corporation, Norcross, Ga.

[21] Appl. No.: 728,762

[22] Filed: Jul. 8, 1991

Related U.S. Application Data

[63] Continuation of Ser. No. 529,349, May 25, 1990, abandoned.

[51] Int. Cl.[5] ..... G03G 15/02; G03G 21/00

[52] U.S. Cl. ..... 355/214; 355/71; 355/219; 355/239

[58] Field of Search ..... 355/71, 214, 219, 221, 355/225, 239, 327

[56] References Cited

U.S. PATENT DOCUMENTS

| | | | |
|---|---|---|---|
| 3,535,036 | 10/1970 | Starkweather | 355/239 |
| 3,540,806 | 11/1970 | Starkweather | 355/239 |
| 3,580,671 | 5/1971 | Lavander | 355/239 |
| 3,724,941 | 4/1973 | Honjo et al. | 355/214 |
| 3,762,811 | 10/1973 | Matsumoto | 355/214 |
| 3,963,342 | 6/1976 | Stark et al. | 355/239 X |
| 4,003,649 | 1/1977 | Goren et al. | 355/239 |
| 4,007,981 | 2/1977 | Goren | 355/327 |
| 4,012,137 | 3/1977 | Goren | 355/239 X |
| 4,095,889 | 6/1978 | Goren | 355/327 |
| 4,108,654 | 8/1978 | Goren | 430/43 |
| 4,179,209 | 12/1979 | Goren | 355/327 |
| 4,821,076 | 4/1989 | Toyoshi et al. | 355/219 |

OTHER PUBLICATIONS

"Pictorial Electrophotography", Bestenreiner, *Photographic Science and Engineering*, vol. 23, No. 2, Mar./Apr. 1979, pp. 93–98.

"Problems of Pictorial Xerography", Goren, *Journal of Applied Photographic Engineering*, vol. 2, No. 1, Winter 1976, pp. 17–27.

"High-Quality Pictorial Xerographic Reproduction by Halftone Screening", Goren, *Journal of Applied Photographic Engineering*, vol. 8, No. 6, Dec. 1982, pp. 233–238.

*Primary Examiner*—Fred L. Braun

*Attorney, Agent, or Firm*—Jones, Askew & Lunsford

[57] ABSTRACT

A dual mode electrophotographic print engine. A voltage controller (25) provides operating voltage to a scorotron (27), which applies a charge to a photoreceptive medium. In a first mode a screen (40) is placed in a first position, out of the optical path between the image focusing device and the photoreceptive medium (45). This produces full exposure of the photoreceptive medium (45) to the focused image. This produces a latent image on the photoreceptive medium. Toner is then applied to the latent image to produce a developed image. In the second mode of operation, for producing half-tone copies, the screen (40) is inserted into the optical path. This reduces the exposure of the photoreceptive medium (45). To compensate for the reduced exposure the voltage controller (25) provides a second, lower voltage to the scorotron. This lower voltage compensates for the reduced exposure time so as to produce a high quality latent image. Toner is then applied to the latent image to produce a developed image. The first mode provides for high quality graphic and textual reproduction, whereas the second mode provides for high quality copying of photographs and other pictorial materials.

29 Claims, 4 Drawing Sheets

EXPOSURE COMPENSATION SYSTEM FOR A DUAL MODE ELECTROPHOTOGRAPHIC PRINT ENGINE

This a continuation of application Ser. No. 529,349, filed May 25, 1990 now abandoned.

TECHNICAL FIELD

The present invention relates to electrophotographic print engines and, in particular, relates to an exposure compensation system for use with an electrophotographic print engine, which can be operated selectively with or without a screen in the optical path.

BACKGROUND OF THE INVENTION

Electrophotography has become one of the most widely utilized systems in the field of information processing. In particular, dry copying or xerography as it is otherwise known, uses electrophotography in creating copies of documents and other materials. Electrophotography has become the stardard process for making copies of documents or other materials in a host of environments including business offices, educational institutions and the like. The basic principles of electrophotography are well known to those skilled in the art.

The fundamental elements of an electrophotographic copier include a photoreceptive medium which is charged to a substantially uniform level. An optical image of an original to be copied is focused onto the photoreceptive medium through the use of a light source and appropriate optics. The optical image of the original illuminates the charged photoreceptive medium thereby dissipating the charge on the photoreceptive medium in accordance with the intensity of the light in the optical image. An electrostatic latent image corresponding to the original is left on the photoreceptive medium.

In most electrophotographic copying systems, the electrostatic latent image is passed through a development station which includes a source of toner materials electrostatically held to ferromagnetic carriers. Magnetic fields acting on the ferromagnetic carries bring the toner materials into contact with the electrostatic latent image. The electrostatic charge on the latent image is strong enough to pull the toner materials away from the ferromagnetic carriers and to hold them in place on the appropriate portions of the electrostatic latent image. The magnetic forces also carry the ferromagnetic carrier particles back to a position where they are remixed with additional toner materials.

As is known to those skilled in the art, the toner materials are normally plastics which melt at a predetermined temperature and have appropriate color characteristics once they are melted.

Having passed through the developed station, the electrostatic latent image is now referred to as the developed image. Subsequently, the photoreceptive medium carrying the developed image is brought into contact with an receptor which, in the most common application of electrophotography, is a sheet of paper. Electrostatic charging techniques are again employed in transferring the toner of the developed image from the photoreceptive medium to the image receptor.

Once the developed image is transferred to the image receptor, it is passed through a device commomly referred to as a fuser. The fuser is a station in the path of the image receptor at which the transferred toner is heated to fix the image onto the image receptor. By this process a monochromatic copy of the original image is created.

In recent years, systems for color electrophotography have been created for the purpose of making color copies of color originals. The systems for color electrophotography are generally analogous to standard three-color printing processes used in the more conventional printing arts. Three different color component electrostatic latent images are created through the illumination of the color original through three separate filters in a manner analogous to the creation of color separations in color printing. Each of the color component electrostatic latent images is developed with a toner having the appropriate color characteristics. Each developed color component image is in turn transferred to the image receptor or paper in superimposed registration with one another in order to provide a composite image. The image receptor carrying the composite image is then passed through a fuser in a conventional manner where the toner is fixed to the image receptor. A system for color electrophotography is more particularly disclosed in the commonly owned patent to Palm, U.S. Pat. No. 4,652,115 for a print engine for color electrophotography, which is incorporated herein by reference.

As discussed above, electrophotographic copying systems have been developed to reproduce color or monochromatic originals. And as discussed in Palm, supra, it is well known in the art to provide an electrophotographic print engine which can reproduce either color or monochromatic originals. However, original documents or materials also may be classified according to whether they are graphic materials or pictorial materials. Graphic materials include textual documents, graphs, and charts wherein subtle variations in shading, tone or color are not present. Contrary thereto, pictorial materials include photographs, drawings and illustrations which may possess subtle variations in shading, tone and color.

Machines desined primarily for graphic and textual reproduction employ high contrast imagery production techniques. These are also referred to as high gamma characteristics, the well known gamma characteristics of print engines being discussed in more detail herein below. In particular, at low density values for an original image, an electrophotographic engine which sharply reduces the copied inage will have bright white (or unfilled) areas and contrast with dark filled areas. Indeed, the contrast in such machines is often exaggerated with respect to the original. This produces the desired quality of good "sharpness" of the copied image.

When photographs or other pictorial source materials are reproduced on such copying machines the image is distorted and undesirable in that a wide range of image densities in the original are reproduced as a narrow range of image densities in the copy, leading to a "muddy" appearance in the pictorial copy. Additionally, high contrast modes of operation on a copying machine exhibit a flattening of the gamma curve at high image densities which may be considered analogous to the phenomenon of clipping in an electronic amplifier. Thus, variations in shading of generally dense portions of the image original will be lost and, after a certain original image density level is reached, all areas in the copy at or above that density will be reproduced at a single high density value, thus further tensing to muddy the pictorial image. Adjustments to gamma characteristics to form better pictorial reproduction lead to lower contrast graphic images which users objectively view as less sharp and less desirable than textual or graphich images reproduced by high contrast machines. The practial results of the phenomenon are familiar to user's of electrophotographic copiers and those skilled in the art.

The subtle variations in shading, tone and color have made it difficult for prior art electrophotohraphy systems to reproduce acceptable copies of pictorial materials. In order to aid electrophotographic copying systems in forming tone gradations, it has been well known in the art to employ a screen in the optical path of an electrophotographic print engine. The screen is positioned usually between the original to be imaged and the photoreceptive medium. Generally, a screen comprises a transparent base medium having a plurality of opaque dots or lines printed thereon. When the screen is in place, the portions of the optical image corresponding to the opaque areas of the screen are blocked from illuminating the photoreceptive medium.

The effect of use of the screen is to produce tonal gradations on the electrostatic latent image by forming half-tone dots or lines of varying size. In the highlight regions where the toner should be less densely applied, the electrostatic latent image formed through use of the screen may comprise narrow lines or small dots. The lines increase in width or the dots in size throughout the intermediate shades until they merge together in the darker areas where toner should be applied most densely. In this manner, there will be completely whiteness in the lightest areas with increasing denseness of applied toner through the intermediate shades and nearly solid black or solid color in the densest areas. The grid thus serves as a diffraction grating.

The density transfer characteristic of an electrophotographic copying machine is often represented in tone reproduction curves (TRCs). Standard tone reproduction curves are Cartesian graphs relating source and image density. A TRC, also known as a gamma curve, is derived from plotting the image density of the original against the image density of the copy. The input tone density is expressed in terms of $\log_{10}$ (100/Ro), where Ro is the percent spectral reflectivity of the original. The output tone density is expressed in terms of $\log_{10}$ (100/Rc) where Rc is the percent spectral reflectivity of the copy. Thus, where the reflectivity approaches 100% (white areas), the tone density approaches 0 ($\log_{10}100/100=0$). Where the reflectivity decreases, (colored or shaded areas), the tone density increases.

The gamma characteristic noted above is the ratio of the output density value to the input density value on the tone reproduction curve at any point. From this, it will be apparent that an ideal copying machine would have a gamma of one for all values of input image density and its tone reproduction curve would be a straight line at 45° on a graph having equal unit spacing on the horizontal and vertical axes. It is well known to those skilled in the art that such an idealized gamma curve is virtually impossible to achieve. This results from the fact that the development process is a linear function of photoreceptor voltage while the exposure process includes a nonlinear function of image density. To be more precise, the density of toner pulled at a development station is a linear function of the voltage on the photoreceptor, which voltage exerts electrostatic force on the charged toner particles in the development mechanism. The discharge of an evenly charged photoreceptor belt varies as the square root of the exposure. This is explained in detail in an article entitled "Problems of Pictorial Xerography" by R. N. Goren in the Winter 1976 issue (Vol. II, No. 1) of the "Journal of Applied Photographic Engineering". The article includes a graphic derivation of nonlinear tone reproduction curves encountered in practical electrophotographic print engines. The "Problems of Pictorial Xerography" article is hereby incorporated by reference exactly as set forth in full herein.

It is also known that generally the tone reproduction curves for electrophotographic print engines passes through the origin of the graph. It is well known that they may be shifted along the vertical axis (output density) in a manner which does not change their shape, but simply amounts to a translation along the output density variable by application of a bias voltage at the development station.

As noted herein above, the use of fine line or dot grid screens interposed in the optical path in an electrophotographic print engine is known in the art. Such screens have the effect of creating half-tone output images which significantly improve the perceived quality of a resultant pictorial image. However, by the inherent nature of the screening device, it reduces the exposure of the photoreceptor, thus increasing the density of the output image since less light is provided to the photoreceptor in areas corresponding to low density areas of the original image.

As explained above, the photoreceptive medium is blocked from illumination in those areas corresponding to the opaque areas of the screen. However, in blocking illumination of certain portions of the photoreceptive medium, the screen effectively reduces the intensity of the optical image. A reduction in the intensity of the illumination results in a general underexposure of the photoreceptive medium. In other words, the use of a screen reduces the optical images intensity and results in a lesser dissipation of the charges on the photoreceptive medium. Since less charge is dissipated, more toner will be attracted to the charged portions of the latent image resulting in more dense application of the toner, and in general, a darker, unacceptable reproduction of the original.

It is well known in the art that the relationship between exposure of the photoreceptive medium and the intensity of the light in the optical image may be expressed generally through the mathematical equation: Exposure=Intensity×Time. Since using a screen reduces the intensity of the light in the optical image, the effect of using a screen is to reduce the exposure of the photoreceptive medium in machines for which the exposure time is constant. For moving belt and drum machines, the exposure time remains unchanged unless the speed of the photoreceptor is varied, which is an undesirable approach. Reduction in the intensity of the light in the optical image results in an underexposed reproduction of the original.

One approach taught by the prior art to the problem of an underexposed copy when a diffusion screen is used is to increase the intensity of the imaging light source. Such a source may be a single higher wattage lamp or an additional lamp. However, this approach has several drawbacks. First, increasing the intensity of the imaging light source requires a lamp or other light source with a higher wattage rating, which is usually more expensive to buy, and to maintain. The higher wattage of the light source may require additional protective circuitry. Further, the power consumption of the imaging light source will increase. Increasing the intensity of the imaging light source also has the effect of heating the platen upon which the original is illuminated. This can raise platen temperature to an unacceptable level according to standards set by the Underwriters Laboratories. The approval of the Underwriters Laboratories is highly desirable for commercially marketed electrophotographic copying systems in the United States.

Another approach to the problem of a reduction in the level of exposure of the photoreceptive medium has been described in the patent to Goren, U.S. Pat. No. 4,007,981. Goren uses a secondary light source or lamp for additional non-image illumination. Goren teaches that this arrangement also produces acceptable half-toning of pictorial images. However, the use of additional lamps or other light sources has several drawbacks. An additional light source requires additional hardware and software support, thereby adding to the complexity of the copying system. The light source must be correctly positioned and its operation synchronized so that its light rays are in registration with the optical image. Further, the light source and its accompanying support system require at least routine maintenance. By adding an additional light source which operates simultaneously with the light source illuminating the original, the power consumption of the machine is increased significantly. All of these factors prohibit the production of a practical full color electrophotographic copying system which is of a size substantially equivalent to conventional table top monochromatic copiers and whose power consumption is controlled so that it may be operated from a conventional 120 volt branch circuit.

Accordingly, there is a need for a system which compensates for the reduction in the intensity of the optical image and the resultant reduction in the exposure level of the photoreceptive medium when a screen is positioned in the optical path, but which does not heat the platen to an unacceptable level. Further, there is a need for an exposure compensation system which can be utilized in a practical electrophotographic print engine which is the size of a conventional table top monochrome copier and whose power consumption is controlled so that it may be operated from a conventional 120 volt branch circuit. In the environment in which the present invention was made, the use of a secondary lamp such as taught by the aforementioned Goren patent, or increasing the light intensity at the imaging source, either by using a higher powered lamp or an additional lamp, was found to be unacceptable to meet the design goal of a copy machine which can be operated on a conventional 120 volt branch circuit.

SUMMARY OF THE INVENTION

The present invention overcomes the above stated technical problems in the prior art in a number of significant aspects. Broadly stated, the present invention provides an exposure compensation system for a dual mode electrophotographic print engine, which can be operated selectively with or without a screen in the optical path.

As explained above, use of a screen in the optical path improves pictorial copy quality, but at the cost of effectively reducing the intensity of the optical image. Using a screen, less charge on the photoreceptive medium is dissipated because the optical image is less intense. A lesser dissipation of the charge on the photoreceptive medium will result in a generally darker or denser copy. The present invention overcomes this problem in a fashion completely different from the approach taught by the prior art, which was simply to increase the intensity of the light image through the use of additional light sources or other means. The present invention compensates for the reduced intensity of the optical image by reducing the charging voltage applied to the photoreceptive medium. By applying a lesser voltage to the photoreceptive medium, a lesser intensity optical image will dissipate proportionally the same amount of charge on the photoconductor as the more intense optical image transmitted without the use of the screen.

In particular, the present invention comprises an exposure compensation system for use with an electrophotographic print engine which can be operated selectively in either the graphic mode or the pictorial mode. The graphic mode of operation is most suitable for reproduction of graphic materials such as textual documents, graphs, charts and the like. The pictorial mode of operation is most suitable for reproduction of pictorial materials such as photographs, drawings, illustrations and the like.

In the preferred embodiment, it is an advantageous aspect that a precision digital controller manages the entire operation of the dual mode electrophotographic print machine including implementation of the graphic or pictorial mode. When an operator selects the pictorial mode, the controller provides a signal to a mechanism such as a solenoid or a motor to move the screen into the optical path. In conjunction therewith, a signal is provided to the voltage control means to reduce the charging voltage applied to the photoreceptive medium. This reduction in the charging voltage compensates for the reduction in exposure of the photoreceptive medium caused by the screen.

When an operator deselects the pictorial mode so that the electrophotographic print engine is functioning in the graphic mode, the controller provides a signal to the solenoid or motor to move the screen out of the optical path. In conjunction therewith, the voltage control means increases the charging voltage applied to the photoreceptive medium so as to accommodate the screen's removal. Thus, the present invention eliminates the need for means for intensifying the optical image such as additional light sources and their accompanying mechanical and electrical support mechanisms.

According to another aspect of the present invention, the exposure compensation system is used as part of an electrophotographic print engine which can function as both a general purpose monochrome office copier and a full color copier. Further, the electrophotographic print engine incorporating the present invention can be operated in a dual mode configuration, i.e. graphic or pictorial mode, whether it is functioning as a monochrome copier or as a full color copier. In addition to the user selectable input for selecting monochrome copying, a user selectable input to select pictorial copying is provided. Therefore, the present invention will provide high quality black and white copies of graphic materials and of pictorial copies. The present invention will also provide high quality color copies of graphic materials and of pictorial materials.

According to yet another aspect of the present invention, the digital controller for an electrophotographic engine embodying the present invention controls the maximum power drawn by the engine during operation. This allows for construction of electrophotographic engines including embodiments of the present invention to be dependably operated from a conventional 120 volt branch circuit. Thus, the user of the present invention does not have to suffer the expense of installing special branch circuits in the environment in which the electrophotographic engine is used.

In addition, the present invention provides an exposure compensation system for a dual mode electrophotographic print engine which is designed specifically to interface with a plurality of image source subassemblies such as a photocopier source subassembly and a laser printer source subassembly.

Therefore, generally stated, it is the object of the present invention to overcome the drawbacks in prior art exposure compensation systems as used in electrophotographic print engines.

More specifically, it is an object of the present invention to provide an exposure system which compensates for the reduced intensity of the optical image when a screen is used in the optical path by reducing the charging voltage applied to the photoreceptive medium.

It is still a further object of the present invention to provide an exposure compensation system for an electrophotographic print engine which includes energy management features allowing the print engine to be operated from a conventional 120 volt branch circuit.

That the present invention satisfies these objects, and overcomes the drawbacks of the prior art, will be appreciated from the detailed description of the preferred embodiment below.

DETAILED DESCRIPTION OF THE PREFERRED EMBODIMENTS

Turning now to the various drawing figures, in which like numerals reference like parts, a detailed description of the preferred embodiment of the present invention will be provided.

The preferred embodiment of the exposure compensation system of the present invention is included as part of a two belt double transfer full color electrophotographic print engine generally of the type disclosed in the commonly owned U.S. Pat. No. 4,652,115 to Palm, cited above and incorporated herein by reference. The entire electrophotographic print engine is operated under the management of a digital electronic controller 10, whose operation is substantially similar to the digital electronic controller explained in detail in the patent to Palm, U.S. Pat. No. 4,652,115, supra. Thus, the controller 10 also controls the implementation of the preferred embodiment of the exposure compensation system responsive to operator selection or deselection of pictorial mode copying.

Figure 1:
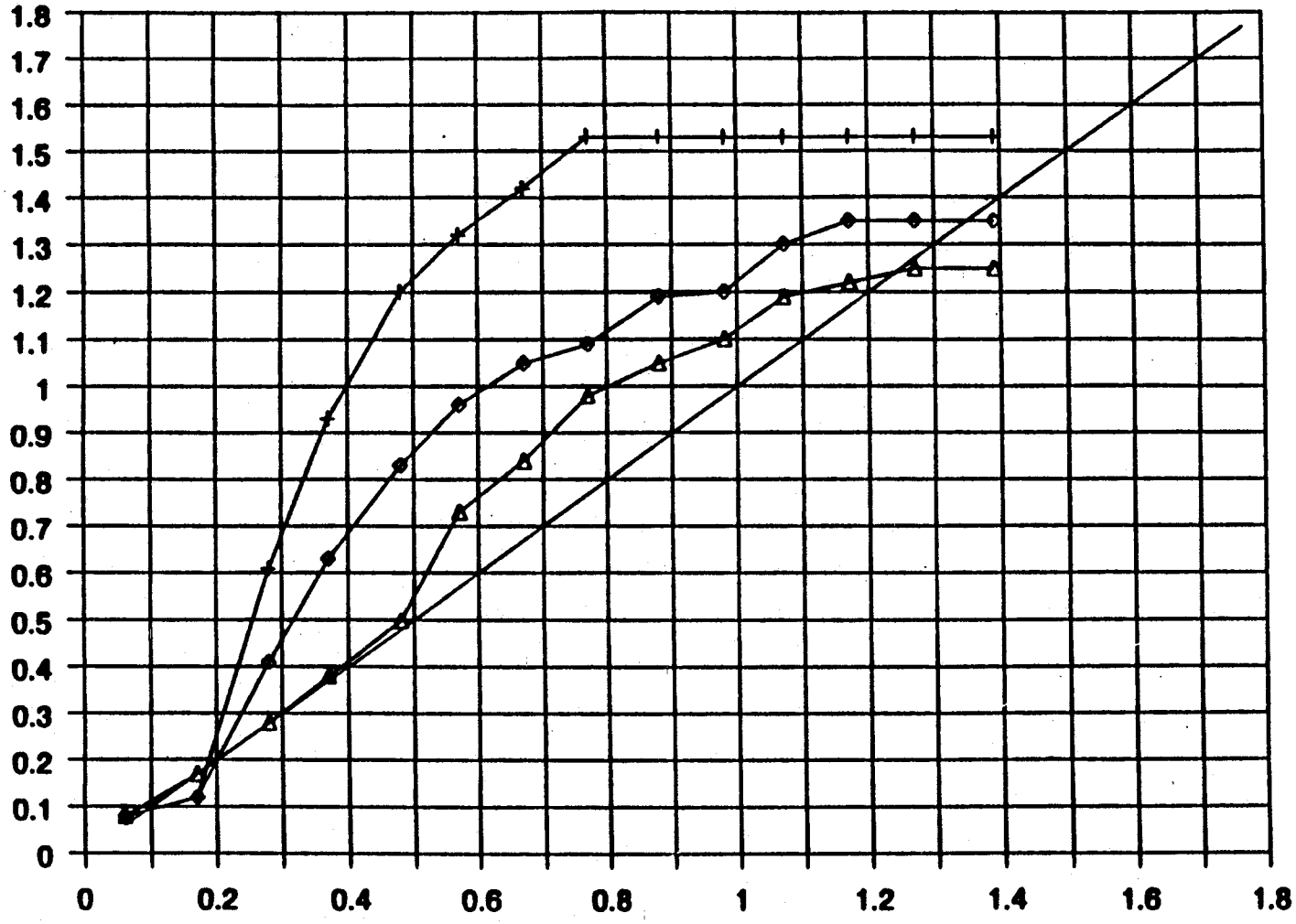
FIG. 1 is a graph of four tone reproduction curves (TRC's) representing optimum tone density reproduction to input, tone density reproduction to input of graphic material, tone density reproduction to input of pictorial material, and tone density reproduction to input of pictorial material when a screen is used in the optical path.

The tone reproduction curves (TRC's) shown in FIG. 1 demonstrate the improvements in pictorial copy quality gained in using a screen in the optical path of a electrophotographic print engine. As noted in the background, a TRC, also known as a gamma curve, is derived from plotting the input tone density of the original against the output tone density of the copy.

In FIG. 1, the solid straight line TRC represents the design goal of a perfect reproduction of all of the original material's tone densities in the copy. The other three curves represent the averaged actual tone density reproduction of an orginal's tone density. A screen was used in the optical path in the reproduction process represented by the curve marked with triangles. However, a screen was not used in the reproduction processes represented by the curves marked with the crosses and with the diamonds.

In FIG. 1, the curve marked by crosses represents the averaged actual tone density reproduction of graphic materials such as textual documents, charts or graphs. The curve marked by diamonds represents the averaged actual tone density reproduction of pictorial type materials. An examination of FIG. 1 reveals that the electrophotographic copying system without the screen in the optical path has difficulty in reproducing faithfully the less dense tones, yet these less dense tones are the ones to which an observer is most sensitive.

FIG. 1 also shows a TRC marked by triangles representing the averaged actual tone density reproduction of pictorial type materials, but which employed a screen in the optical path. A comparison of the curves reveals that the use of the screen produced a much truer tone density reproduction of the pictorial original in the observer-sensitive less dense tones.

It should be noted, however, that with use of the screen there is some sacrifice in true tone density reproduction in the highly dense tones. Nonetheless, studies have indicated that this difference in reproduction in the highly dense tones is acceptable to the observer, and is not as noticeable as the same amount of discrepancy in tone density reproduction in the less dense tones. Thus, the tone reproduction curves demonstrate that use of the screen in the optical path maximizes tone density reproduction of the original's less dense tones, while minimally sacrificing tone density reproduction of the original's highly dense tones.

Figure 2:
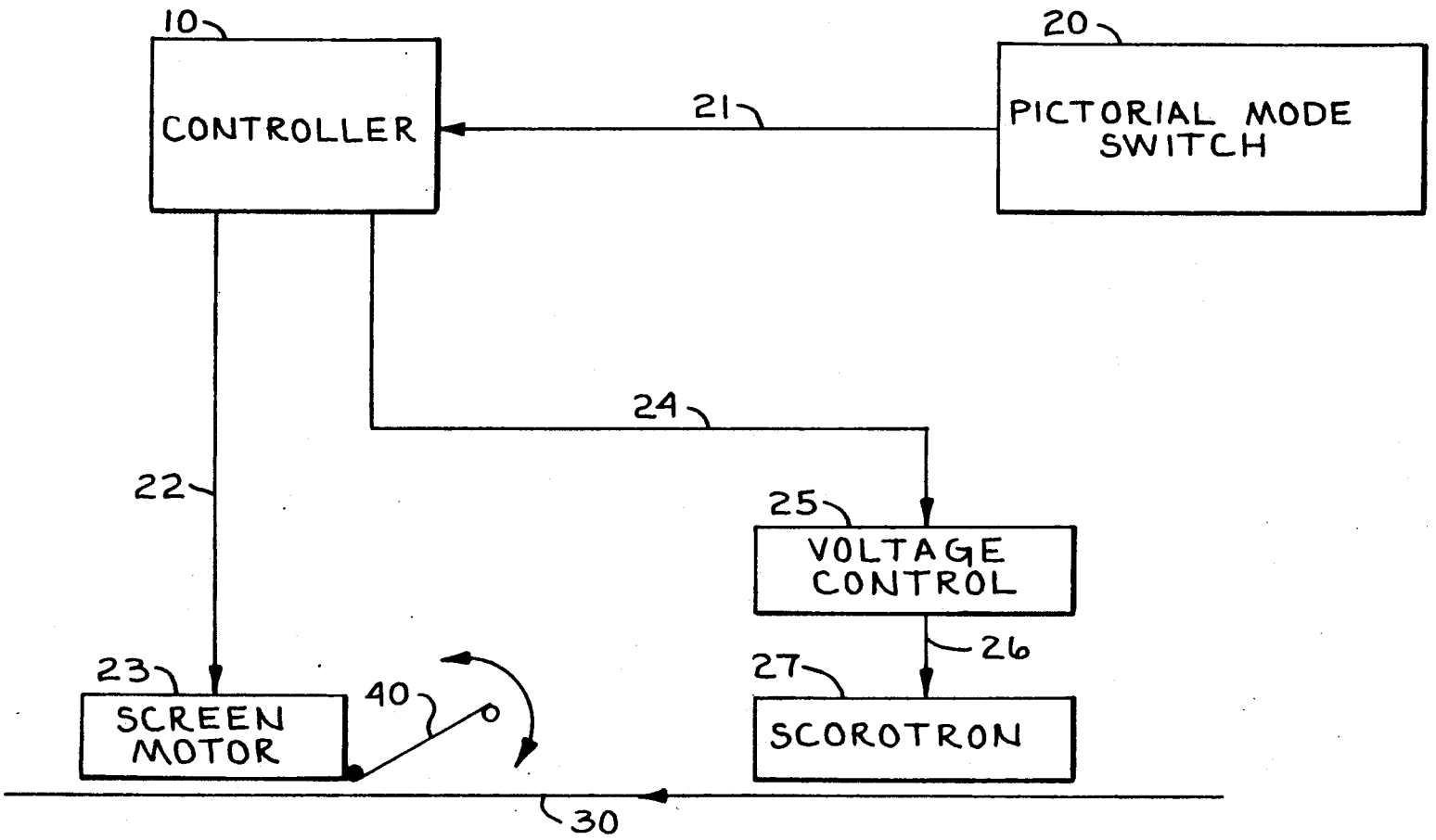
FIG. 2 is an overall block diagram of the selection and control apparatus for the preferred embodiment.

FIG. 2 is an overall diagram of the selection and control apparatus for the preferred embodiment of the exposure compensation system. In the electrophotographic print engine's graphic mode of operation, the controller 10 provides a signal on line 24 to the voltage control 25 that the electrophotographic print engine is in the graphic mode. In response to this signal, the voltage control 25 provides a signal on line 26 to the scorotron 27 to charge the photoreceptive medium 30 to a predetermined state. In the preferred embodiment, the photoreceptive medium 30 will be charged to an approximate value of 310 volts in the graphic mode.

An operator desiring to obtain better quality copies of pictorial materials such as photographs, illustrations and the like selects the pictorial mode of operation for the electrophotographic print engine by activating the pictorial mode switch 20. Of course, it will be realized that means other than a switch may be used to select the pictorial mode. Upon operator selection of the pictorial mode, a signal is provided on line 21 to the controller 10 that the pictorial mode of operation for the electrophotographic print engine is desired. In response to the signal on line 21, the controller 10 provides a signal on line 22 to the screen motor 23 to move the screen 40 into the optical path. It will be understood to those skilled in the art that a solenoid or other means may be used to move the screen 40 into and out of the optical path.

Also in response to the signal on line 21, the controller 10 provides a signal on line 24 to the voltage control 25 that the electrophotographic print engine is in the pictorial mode. In response to this signal, the voltage control 25 provides a signal on line 26 to the scorotron 27 to charge the photoreceptive medium 30 to a predetermined state according to the pictorial mode. The charge applied to the photoreceptive medium 30 in the pictorial mode will be lower than that applied when the electrophotographic print engine is in the graphic mode in order to compensate for use of the screen 40 in the optical path. In the preferred embodiment, the photoreceptive medium 30 will be charged to an approximate value of 250 volts in the pictorial mode.

Figure 3:
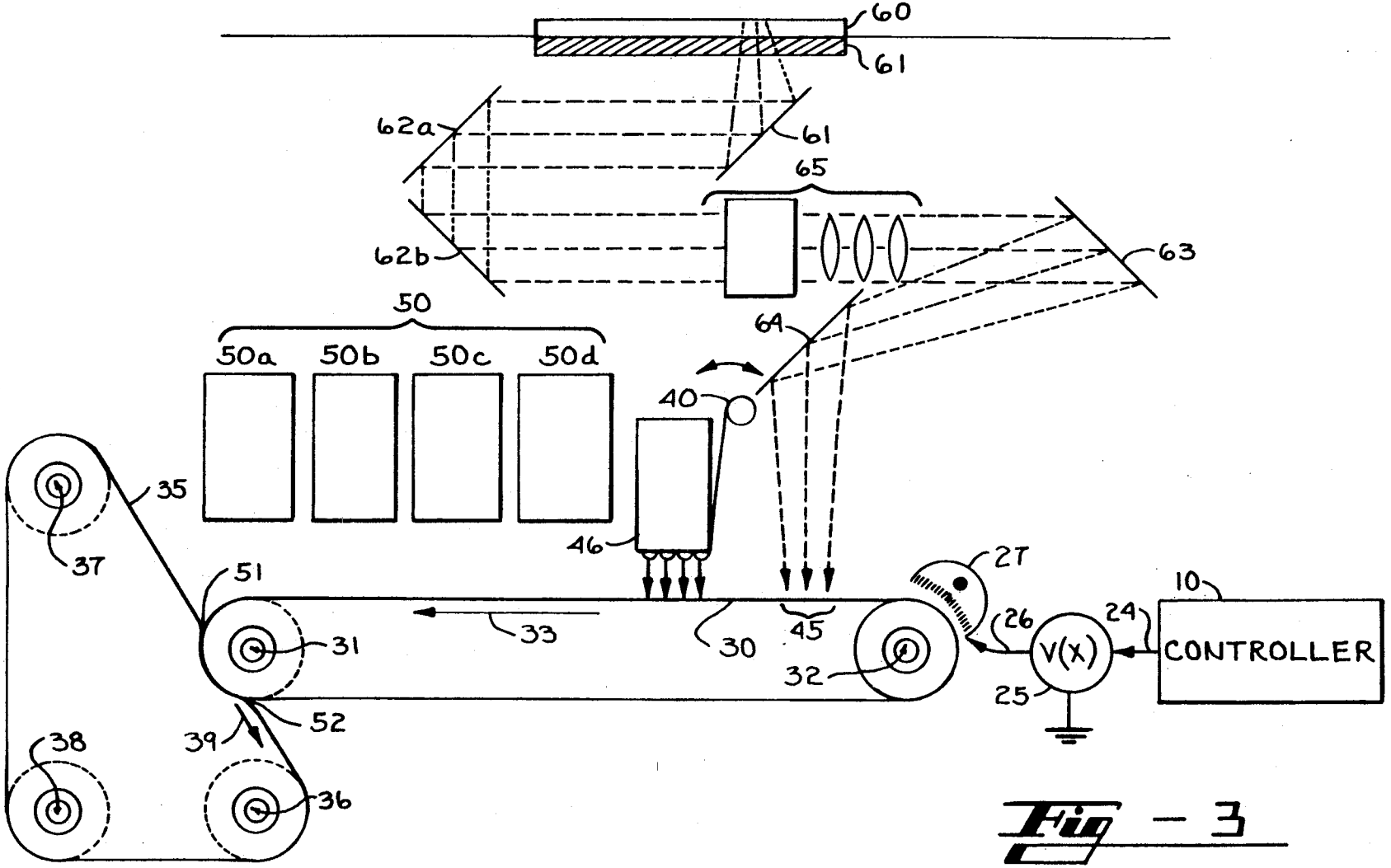
FIG. 3 is an overall diagram of the major components of the image development system of the preferred embodiment.

FIG. 3 is a diagram of the major components of the image development system incorporating the preferred embodiment of the present invention. Greater detail of the major components and their operation is found in U.S. Pat. No. 4,652,115 to Palm, cited above. A digital electronic controller 10 is used to appropriately synchronize, and in some cases intentionally unsynchronize, operation of components of the system in order to achieve optimum results from the electrophotographic print engine. The controller is also described in greater detail in U.S. Pat. No. 4,652,115 to Palm, cited above.

FIG. 3 depicts operation of the electrophotographic print engine in the graphic mode with the screen 40 removed from the optical path. Greater detail of the movement of the screen 40 into the optical path and the pictorial mode of operation will be discussed with respect to FIG. 4. In the graphic mode, the controller 10 provides a signal on line 24 to the voltage control 25 to apply a certain charging voltage to the photoreceptive medium 30. In the preferred embodiment, the voltage control 25 provides a signal on line 26 to the scorotron 27 which applies the charging voltage. The scorotron 27 is a conventional exposure scorotron of a type well known to those skilled in the art. The charging voltage applied to the photoreceptive medium 30 is approximately 310 volts in the preferred embodiment's graphic mode of operation.

The original to be copied is placed on glass platen 60. An optical image of the original is created by the optics bench 61. As the photoceptive medium 30 moves past expose station 45, light from optics bench 61 is focused onto the photoreceptive medium 30 in synchronism with its movement to provide an electrostatic latent image on the photoreceptive medium 30. The optical image is focused directly onto the photoreceptive medium 30 through the use of mirrors 61, **62*a*, 62*b*, 63 and 64 and lenses 65**. The focusing of the optical image onto a photoreceptive medium is well known to those skilled in the art.

As described in the background of the invention, focusing the optical image onto the photoreceptive medium 30 dissipates the charge on the photoreceptive medium 30 in accordance with the intensity of the optical image. An electrostatic latent image is left on the photoreceptive medium 30. In the preferred embodiment and as shown in FIG. 3, the photoreceptive medium 30 is depicted as a belt 30 mounted about a pair of rollers on pivot points 31 and 32. The belt 30 is driven around in the direction indicated by arrow 33 by a motor (not shown).

In the preferred embodiment, after an electrostatic latent image is created on the photoreceptive medium 30 it is processed according to the manner set forth in greater detail in U.S. Pat. No. 4,652,115 to Palm, cited above. Generally, the electrostatic latent image passes through the void lamp assembly 46 where excess charges not associated with the electrostatic laten image are dissipated in a manner well known to those skilled in the art. The electrostatic latent image then passes through the development station 50 represented by the four toner modules **50*a*, 50*b*, 50*c* and 50*d*. As shown in FIG. 3, the toner station 50 is installed above the photoreceptive medium 30**. In the preferred embodiment, three of the toner modules hold toner materials for the three color process toners and the fourth toner module holds toner for monochrome copying. In another embodiment of the invention, up to five toner modules may be installed. The fifth toner module is provided for custom colors, not reproduceable through the use of available process colors.

After development, the developed image is passed on to intermediate transfer belt 35. The transfer belt 35 is mounted about three rollers on pivot points 36, 37 and 38. The transfer belt 35 is driven around in the direction indicated by arrow 39 by a motor (not shown).

If color copying is taking place, an appropriate separation filter (not shown) is interposed in the optical path in a known manner. As photoreceptive medium 30 moves past the expose station 45 in the direction shown by arrow 33, an electrostatic latent image of this particular color component is created on photoreceptive medium 30 in a manner which will be familiar to those skilled in the art, and which was described in the background of the invention.

Assume that the first color developed corresponds to the color contained in toner module **50*a*. As a developed image moves past toner module 50*a*, the module is activated to deposit toner materials on the charged portions of the surface of belt 30 to provide a developed image of this color component of the original. As belt 30 continues to rotate, the leading edge of the developed image eventually reaches point 51 at which belt 30 first makes contact with belt 35. The developed image is transferred from belt 30 to belt 35 as the belts continue to rotate and the image passes from point 51 to point 52**.

Second and third color component developed images are created in a similar manner and transferred to belt 35 in registration with the first color component to create a complete composite image. The developed image, or the complete composite image if color copying is taking place, is transferred to an image receptor such as a piece of paper for the final stages of the electrophotographic printing process (not shown). These final steps include fusing and are described in greater detail in U.S. Pat. No. 4,652,115 to Palm, cited above.

Figure 4:
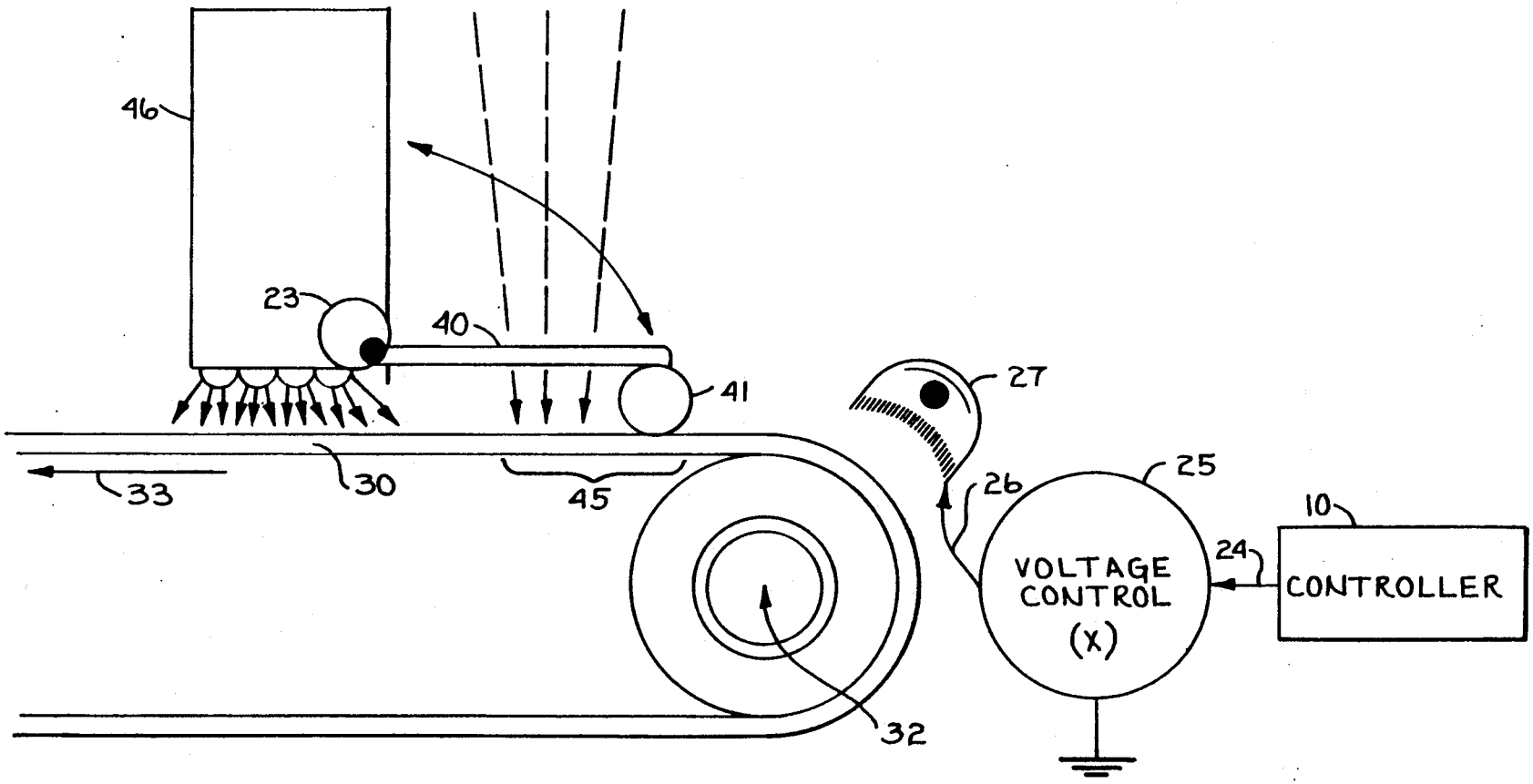
FIG. 4 is a diagram of the exposure compensation system of the preferred embodiment.

FIG. 4 depicts in greater detail the operation of the electrophotographic print engine in the pictorial mode, which differs from the graphic mode described above in that the screen 40 is moved into the optical path and the charging voltage applied to the photoreceptive medium 30 is reduced. In the preferred embodiment, the screen 40 is a line screen well known to those skilled in the art and of a type available from ByChrome Company of Columbus, Ohio and other vendors. The screen 40 is the same width, approximately 11.7 inches, as the photoreceptive belt 30 used in the preferred embodiment. The length of the screen 40 is 1 inch, and it is 0.1 mm thick. The line screen of the preferred embodiment has approximately 130 lines per inch with a 30% line width, i.e., each line is approximately 0.0586 mm. While a line screen is described in connection with the preferred embodiment, it will be understood to those skilled in the art that other types of screens may be used.

FIG. 4 illustrates that in the preferred embodiment the screen 40 is attached along its width to the base of the void lamp assembly 46. It should be noted that attachment of the screen 40 to the void lamp assembly 46 is a matter of convenience in that it eases installation and provides for easy cleaning. Other methods well known to those skilled in the art may be used to position the screen 40 so that it may be moved into and out of the optical path. In the graphic mode, the screen 40 lies flat against the void lamp assembly 46 and perpendicular to the path of the photoreceptive medium 30. However, in the pictorial mode as illustrated in FIG. 4, the screen 40 is moved into the optical path and lies parallel to the path of the photoreceptive medium 30. In the preferred embodiment, the screen 40 is moved into or out of the optical path by the operation of a motor 23. Although a motor 23 is shown in FIG. 4 as the means for moving the screen 40 into and out of the optical path, it will be understood by those skilled in the art that a solenoid or other means may be used to accomplish the same result.

As was stated above, in the pictorial mode the screen 40 is positioned in the optical path parallel to the photoreceptive medium 30. In the preferred embodiment, it was found that the optimum distance for placement of the screen was approximately 1 millimeter above the photoreceptive medium 30. At greater distances, exposure of the electrostatic latent image is reduced. In the preferred embodiment, the screen 40 is held to a position approximately 1.2–1.7 millimeters above and parallel to the photoreceptive medium 30 by small wheels 41. These wheels are of a type generally well known in the art. The wheels 41 are attached to the corners of the screen 40 opposite that side of the screen 40 connected to the void lamp assembly 46. The wheels 41 are approximately 9 millimeters in diameter. The wheels 41 are placed so that the screen 40 is kept approximately 1.2–1.7 millimeters above the photoreceptive belt 30. The wheels 41 rest upon the photoreceptive belt 30 and freely rotate so as not to hinder the motion of the photoreceptive belt 30 in the direction of arrow 33.

As stated above, the pictorial mode also differs from the graphic mode in that the charging voltage applied to the photoreceptive medium is reduced. As illustrated in FIG. 4, upon operator selection of the pictorial mode, the controller 10 provides a signal represented on line 24 to the voltage control 25 of the change in mode of operation. The voltage control 25 provides a signal represented by line 26 to the charging means 27 to reduce the charging voltage applied to the photoreceptive medium 30. In the preferred embodiment, and as discussed with respect to FIG. 3, the charging means 27 is a conventional exposure scorotron, and the photoreceptive medium 30 is charged to an approximate value of 250 volts in the pictorial mode.

As explained in the background, use of the screen 40 in the optical path blocks irradiation of those areas of the photoreceptive medium 30 corresponding to the opaque areas of the screen 40. However, in blocking irradiation of certain portions of the photoreceptive medium 30, the screen 40 effectively reduces the intensity of the optical image. A reduction in the intensity of the irradiation results in a general underexposure of the photoreceptive medium 30 in prior art devices. In other words, the use of a screen in prior art devices reduces the optical image's intensity and results in a lesser dissipation of the charges on the photoreceptive medium. As explained above, the present invention compensates for the reduced intensity of the optical image by reducing the voltage applied to the photoreceptive medium. Thus, the less intense optical image which has passed through the screen 40 will dissipate proportionally the same amount of charge on the reduced voltage photoreceptive medium 30 as the more intense optical image focussed directly onto the more highly charged photoreceptive medium.

It should be noted from inspection of FIGS. 3 and 4 that it is the absence of additional light sources in the preferred embodiment which allows the machine to be constructed so that its size approximates that of a conventional convenience table top copying machine. The absence of additional light sources also allows for the construction of electrophotographic print engines including embodiments of the present invention which may be dependably operated from a conventional 120 volt branch circuit.

Thus, in the preferred embodiment, upon operator selection of the pictorial mode of operation the controller 10 provides two signals. The controller 10 provides a signal to the motor 23 to move the screen 40 from its position against the void lamp assembly 46 into the optical path. The screen 40 lies parallel to the photoreceptive medium 30 and is positioned approximately 1.2–1.7 millimeters above the photoreceptive medium 30 by wheels 41. The controller 10 also provides a signal to the voltage control 25 to reduce the applied voltage to the photoreceptive medium 30 to compensate for the reduced intensity of the optical image irradiating the photoreceptive medium 30.

It will be understood by those skilled in the art that operator deselection of the pictorial process will result in a reversal of the above described steps. The controller 10 will again provide two signals to the compensation system. The controller 10 will provide a signal to the motor 23 to move the screen 40 out of the optical path. This will return the screen 40 to its position against the void lamp assembly 46. The controller 10 will also provide a signal to the voltage control 25, which in turn will signal the charging means to increase the applied voltage to the photoreceptive medium 30.

From the foregoing description of the preferred embodiment, it will be appreciated that the present invention overcomes the drawbacks of the prior art and meets the objects of the invention cited hereinabove. In view of the teachings of this specification, other alternative embodiments will suggest themselves to those skilled in the art. Therefore, the scope of the present invention is to be limited only by the claims below.

I claim:

1. An electrophotographic print engine, comprising:

means for allowing for the selection of a graphics mode of operation or a pictorial mode of operation;

means for providing a selected voltage, said selected voltage being a first predetermined non-zero voltage for said graphics mode or a second predetermined non-zero voltage for said pictorial mode;

charging means responsive to said selected voltage for charging a photoreceptive medium;

focusing means for focusing an optical image onto said photoreceptive medium to produce a latent image;

means for selectively inserting a screen into an optical path between said focusing means and said photoreceptive medium when said pictorial mode of operation is selected;

means for providing toner to said photoreceptive medium to produce a developed image;

means for transferring said developed image to an image receptor; and means for fixing said developed image onto said image receptor.

2. The electrophotographic print engine of claim 1 and further comprising a void lamp assembly for dissipating charges on said photoreceptive medium which are not associated with said latent image.

3. The electrophotographic print engine of claim 1 and further comprising means for producing said optical image from an original image.

4. The electrophotographic print engine of claim 1 wherein said means for providing said toner comprises a plurality of toner modules.

5. The electrophotographic print engine of claim 4 wherein each toner module of said plurality of toner modules contains a selected color process toner material.

6. The electrophotographic print engine of claim 5 and further comprising means for producing a color component latent image.

7. The electrophotographic print engine of claim 5 and further comprising means for causing a selected one of said toner modules to provide said color process toner material to said photoreceptive medium to produce said developed image.

8. The electrophotographic print engine of claim 7 wherein said selected one of said toner modules provides said color process toner material to said photoreceptive medium to produce a selected color component developed image.

9. The electrophotographic print engine of claim 8 including means for registering a plurality of said selected color component developed image to produce a color composite image.

10. The electrophotographic print engine of claim 4 wherein at least one of said plurality of toner modules contains monochrome process toner material.

11. The electrophotographic print engine of claim 10 and further comprising means for causing said one of said plurality of toner modules to provide said monochrome process toner material to said photoreceptive medium to produce said developed image.

12. The electrophotographic print engine of claim 11 wherein said one of said toner modules provides said monochrome process toner material to said photoreceptive medium to produce a monochrome developed image.

13. The electrophotographic print engine of claim 1 wherein said means for providing said toner provides a monochrome process toner material.

14. The electrophotographic print engine of claim 1 wherein said developed image is a monochrome developed image.

15. The electrophotographic print engine of claim 1 wherein said means for providing said selected voltage provides approximately 310 volts for said first predetermined voltage and approximately 250 volts for said second predetermined voltage.

16. The electrophotographic print engine of claim 1 and further comprising means for supporting said screen parallel to said photoreceptive medium when said screen is in said optical path.

17. The electrophotographic print engine of claim 16 wherein said means for supporting said screen comprises a pair of wheels.

18. The electrophotographic print engine of claim 1 where said charging means comprises a scorotron.

19. The electrophotographic print engine of claim 1 wherein said focusing means comprises a mirror and a lens.

20. The electrophotographic print engine of claim 1 wherein said means for providing toner comprises a development station.

21. The electrophotographic print engine of claim 1 wherein said means for transferring comprises a transfer belt.

22. The electrophotographic print engine of claim 1 wherein said means for selectively inserting said screen comprises an electric motor.

23. The electrophotographic print engine of claim 1 wherein said means for selectively inserting said screen comprises a solenoid.

24. A method for producing a copy of an original, comprising the steps of:

allowing the selection of a graphics mode of operation or a pictorial mode of operation;

providing a selected voltage, said selected voltage being a first predetermined non-zero voltage for said graphics mode and a second predetermined non-zero voltage for said pictorial mode;

charging a photoreceptive medium in response to said selected voltage;

focusing an optical image of said original onto said photoreceptive medium to produce a latent image;

selectively inserting a screen into an optical path between said original and said photoreceptive medium for said pictorial mode;

providing toner to said photoreceptive medium to produce a developed image;

transferring said developed image to an image receptor; and fixing said developed image onto said image receptor.

25. The method of claim 24 and further comprising the step of dissipating charges on said photoreceptive medium which are not associated with said latent image.

26. The method of claim 24 wherein said step of providing toner comprises:

causing one of a plurality of toner modules to provide a selected color process toner material;

producing a color component latent image; and providing said selected color process toner material to said photoreceptive medium to produce a color component developed image.

27. The method of claim 24 wherein said step of providing toner further comprises:

causing one of a plurality of toner modules to provide a monochrome process toner material; and providing said monochrome process toner material to said photoreceptive medium to produce a monochrome developed image.

28. The method of claim 24 wherein said step of providing said selected voltage comprises providing approximately 310 volts for said first predetermined voltage and 250 volts for said second predetermined voltage.

29. The method of claim 24 wherein said step of selectively inserting said screen into said optical path comprises supporting said screen parallel to said photoreceptive medium.

* * * * *